US006499835B1

(12) United States Patent
Chee et al.

(10) Patent No.: US 6,499,835 B1
(45) Date of Patent: Dec. 31, 2002

(54) INK DELIVERY SYSTEM FOR AN INKJET PRINTHEAD

(75) Inventors: Swee Guan Chee, Singapore (SG); Sieo Peng Clara Chua, Singapore (SG); Jiansan Sun, Singapore (SG); Wan Sin Ng, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/055,405

(22) Filed: Jan. 23, 2002

(30) Foreign Application Priority Data

Oct. 30, 2001 (SG) ..... 200106654

(51) Int. Cl.[7] ..... B41J 2/05
(52) U.S. Cl. ..... 347/63; 347/65
(58) Field of Search ..... 347/44, 47, 56, 347/63, 65, 61, 67, 94

(56) References Cited

U.S. PATENT DOCUMENTS

| | | | | |
|---|---|---|---|---|
| 4,394,670 A | | 7/1983 | Sugitani et al. | 347/65 |
| 4,688,054 A | | 8/1987 | Inamoto et al. | 347/65 |
| 4,719,472 A | | 1/1988 | Arakawa | 347/67 |
| 4,875,968 A | | 10/1989 | O'Neill et al. | 216/27 |
| 5,017,947 A | | 5/1991 | Masuda | 347/65 |
| 5,387,314 A | * | 2/1995 | Baughman et al. | 347/65 |
| 5,463,413 A | | 10/1995 | Ho et al. | 347/65 |
| 5,582,678 A | | 12/1996 | Komuro | 216/27 |
| 5,760,803 A | | 6/1998 | Yamamoto et al. | 347/47 |
| 5,793,393 A | | 8/1998 | Coven | 347/65 |
| 5,808,644 A | | 9/1998 | Imamura et al. | 347/93 |
| 5,912,685 A | | 6/1999 | Raman | 347/65 |
| 6,000,787 A | | 12/1999 | Weber et al. | 347/65 |
| 6,162,589 A | | 12/2000 | Chen et al. | 347/47 |

FOREIGN PATENT DOCUMENTS

| | | | |
|---|---|---|---|
| EP | 0177932 | 4/1989 | B41J/3/04 |
| EP | 0534414 | 3/1993 | B41J/2/16 |

* cited by examiner

*Primary Examiner*—John Barlow
*Assistant Examiner*—Juanita Stephens

(57) ABSTRACT

An ink-firing element is provided. The ink-firing element has a resistor for generating ink droplets, a substrate atop which the resistor rests and a barrier layer atop the substrate. The barrier layer in a closed-loop design and at least partially defines an ink-firing chamber, which surrounds the resistor and temporarily contains ink. The ink-firing element also includes an orifice plate supported by the barrier layer for providing an orifice through which the ink droplets are ejected onto a medium and a trench in the substrate for replenishment of ink. The trench terminates at an outlet in the ink-firing chamber and is in fluid communication with an ink refill channel, which supplies ink from a reservoir to the ink-firing element.

10 Claims, 7 Drawing Sheets

INK DELIVERY SYSTEM FOR AN INKJET PRINTHEAD

BACKGROUND OF THE INVENTION

This invention relates to inkjet printhead structures.

The basic concept of inkjet printing is an ink-firing element having an ink-firing chamber with an orifice for ejecting ink and an ink heating mechanism, generally a resistor, in close proximity to the orifice. In operation, the resistor is quickly heated. The heating transfers a significant amount of energy to the ink, thereby vaporizes a small portion of the ink and produces a bubble in the ink-firing chamber. This in turn creates a pressure wave which propels an ink droplet or droplets from the orifice onto a nearby recording medium such as paper.

Normally, the ink-firing chamber is formed by a semiconductor substrate atop which the resistor rests, an orifice plate which defines the orifice, and a barrier layer sandwiched between the substrate and the orifice plate for supporting the orifice plate. Ink flows from an ink reservoir through an ink refill channel to each ink-firing element. An ink conduit in fluid communication with the ink refill channel is provided in the barrier layer for refilling the ink-firing chamber subsequent to the vaporization process which ejects an ink droplet. The ink conduit is usually formed by creating an open portion in the barrier layer.

The orifice plate, especially if it is a flexible polymer orifice membrane, may sag at the place where the ink conduit exists, since the ink conduit, i.e., an open portion in the barrier layer, provides insufficient support to the part of the orifice plate thereabove. The sag consequently affects the flatness of the orifice plate. Such an effect on the flatness of the orifice plate may cause the orifice to be uncontrollably deformed or tilted thus resulting in inaccurate trajectory of the ink droplets and less than an optimum quality of printing.

Therefore, there is a need for a printhead in which sag of the orifice plate is reduced.

SUMMARY

In an embodiment according to the invention, an ink-firing element includes a resistor for generating ink droplets, a substrate atop which the resistor rests and a barrier layer atop the substrate. The barrier layer is in a closed-loop design and at least partially defines an ink-firing chamber, which surrounds the resistor and temporarily contains ink. The ink-firing element also includes an orifice plate supported by the barrier layer for providing an orifice through which the ink droplets are ejected onto a medium and a trench in the substrate for replenishment of ink. The trench terminates at an outlet in the ink-firing chamber and is in fluid communication with an ink refill channel, which supplies ink from a reservoir to the ink-firing element.

According to an aspect of the invention, a supporter is provided above the trench for supporting a portion of the barrier layer thereabove.

In another embodiment according to the invention, an ink-firing element includes a resistor for generating ink droplets, a substrate atop which the resistor rests, a barrier layer atop the substrate and an orifice plate supported by the barrier layer for providing an orifice through which the ink droplets are ejected onto a medium. The barrier layer partially surrounds the resistor and defines an ink-firing chamber. The ink-firing element also includes an ink conduit provided in the barrier layer for supplying ink from an ink refill channel to the ink-firing chamber. The ink refill channel supplies ink from a reservoir to the ink-firing element. Furthermore, the ink-firing element includes a trench provided in the substrate for supplementary replenishment of ink. The trench is in fluid communication with the ink refill channel and terminates at an outlet in the ink-firing chamber.

In an embodiment of a process for producing an ink-firing element, a supporting layer of a pre-defined pattern is first applied above a substrate atop which a resistor rests for generating ink droplets. The substrate is then etched to form a trench therein, and the trench is in fluid communication with an ink refill channel, which supplies ink from an ink reservoir to the ink-firing element. Subsequently, a barrier layer is attached atop the substrate. The barrier layer at least partially defines an ink-firing chamber and is positioned such that the trench in the substrate terminates at an outlet in the ink-firing chamber. After that, an orifice plate is placed above the barrier layer for providing an orifice through which the ink droplets are ejected onto a medium.

Other aspects and advantages of the invention will become apparent from the following detailed description taken in conjunction with the accompanying drawings, which illustrates by way of example the principles of the invention.

DETAILED DESCRIPTION

Figure 1:
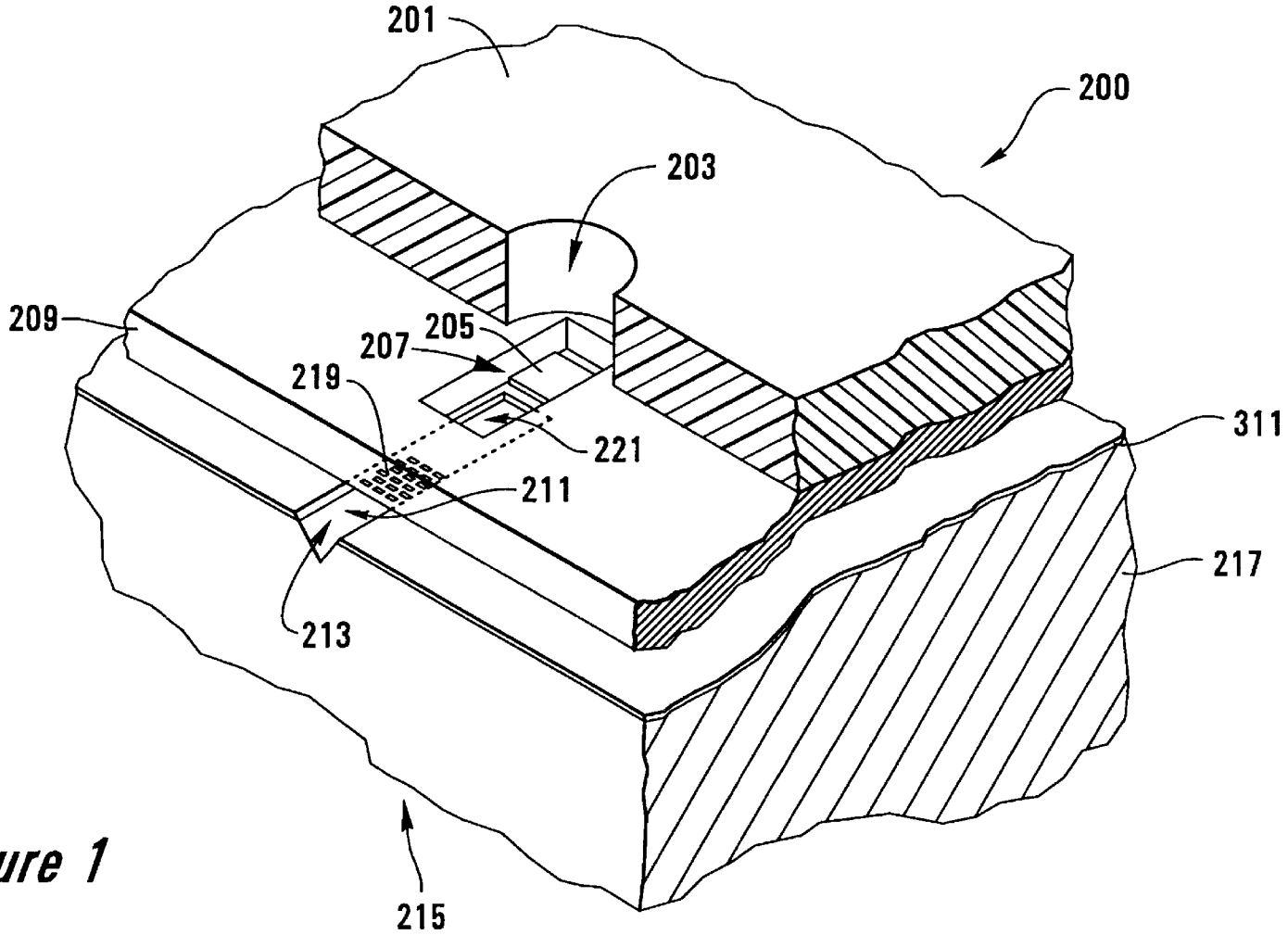
FIG. 1 partially illustrates an ink-firing element according to a first embodiment of the invention.

FIG. 1 illustrates an isometric view of an ink-firing element 200, that is, a portion of a printhead of a printer cartridge, in accordance with the invention. The ink-firing element 200 has a resistor 205 resting atop a semiconductor substrate 217 for generating ink droplets. An orifice plate 201, such as a flexible polymer orifice membrane, is arranged such that an orifice 203, which extends from the inner surface of the orifice plate 201 to the outer surface, is centered essentially over the resistor 205 for ejecting the ink droplets onto a print medium. A polymeric barrier layer 209 sandwiched between the substrate 217 and the orifice plate 201 is provided for supporting the above orifice plate 201 and for at least partially defining an ink-firing chamber 207 which surrounds the resistor 205. In addition, as shown in FIG. 1, the barrier layer 209 is offset from an ink refill channel 215, which supplies ink from an ink reservoir (not shown) of the cartridge. In a center feed construction, the ink refill channel 215 is etched through a portion of the substrate 217. In an edge feed construction, the ink refill channel 215 can be formed from facing edges of two adjacent substrates.

The ink-firing chamber 207, which is also defined by the orifice plate 201 and the substrate 217, temporarily stores ink before an ink droplet is fired. In the embodiment of FIG. 1, the barrier layer 209 has a closed-loop structure, that is, a structure having a contiguous inner wall without any openings in the wall. The inner wall of the barrier layer defines the four sides of the ink-firing chamber 207, and preferably, the barrier layer 209 has a uniform thickness. Such a closed-loop structured barrier layer provides additional support to the orifice plate 201 above for reducing sag of the orifice plate 201.

In the embodiment, a trench 211 is provided in the substrate 217 for replenishing ink from the ink refill channel 215 to the ink-firing chamber 207. The trench has an open end 213 to the ink refill channel 215 and terminates at an outlet 221 in the floor of the ink-firing chamber 207 so as to provide an ink flow path between the ink refill channel 215 and the ink-firing chamber 207. The trench 211 can be formed by using etch technology to remove unwanted areas of the substrate. Preferably, the trench 211 is in a V-shape as shown in FIG. 1 due to the nature of wet etch on silicon crystal. Preferably the width of such a trench is approximately the same as the width of the resistor 205.

Furthermore, an additional supporting layer such as a silicon carbide or silicon nitride (hereinafter SiC/SiN) layer 311 can be provided between the substrate 217 and the barrier layer 209. A supporter 219 can be created in such a layer between a portion of the trench 211 and a portion of the barrier layer 209. Such a supporter 219 provides additional support to the portion of the barrier layer 209 thereabove and prevents the above barrier layer 209 from sagging into the trench 211. Consequently, the supporter 209 reinforces the support to the orifice plate 201 provided by the barrier layer 209.

Figure 3A:
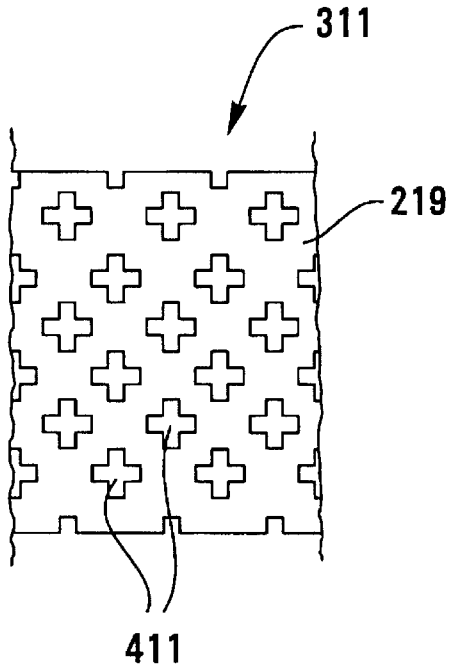
FIG. 3 illustrates different types of supporter used in the preferred embodiments.
Figure 3B:
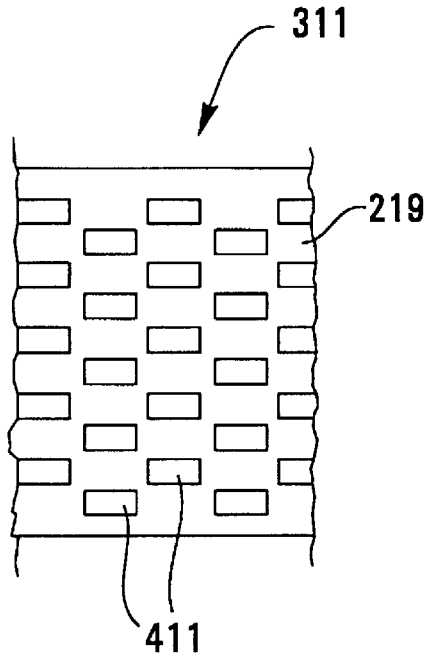

FIG. 3 illustrates two different types of the supporter 219. As shown, the supporter 219, is a portion of the SiC/SiN layer 311 connected to other parts of the SiC/SiN layer, preferably with holes 411 therein.

Figure 2:
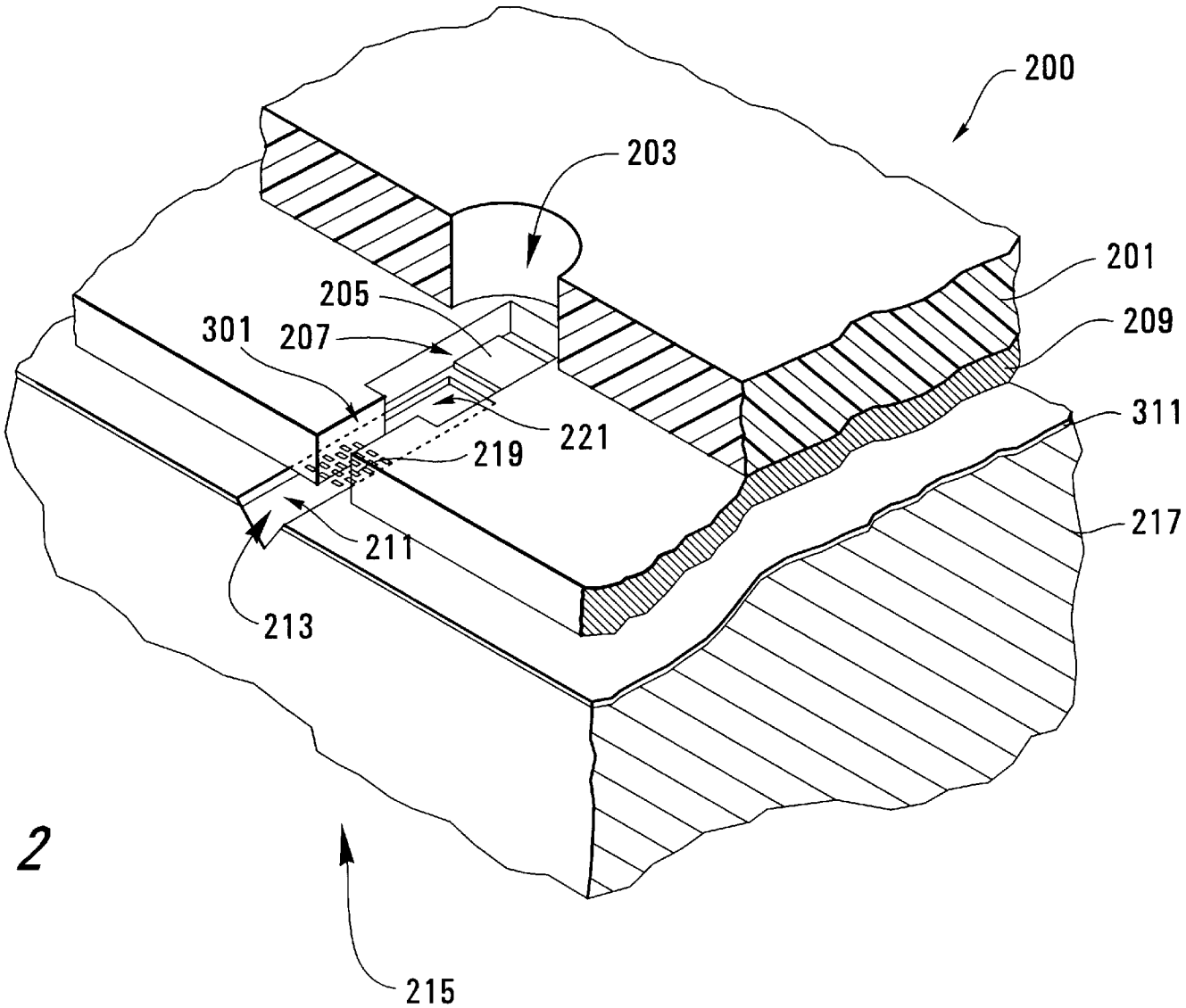
FIG. 2 partially illustrates an ink-firing element according to a second embodiment of the invention.

A second embodiment of the invention is shown in FIG. 2. An ink conduit 301 is provided in the barrier layer 209 for replenishment of ink from the ink refill channel 215 to the ink-firing chamber 207. In this embodiment, the maximum distance between two sides of the opening 301 is designed to be substantially narrower than the width of the resistor 205 so as to provide additional support to the above orifice plate 201 and to reduce sag of the orifice plate 201 into the ink conduit 301. In the preferred embodiment, the maximum distance is not more than two-fifths of the width of the resistor 205.

In the second embodiment shown in FIG. 2, a trench 211 is also provided in the substrate 217 for supplementary replenishment of ink from the ink refill channel 215 to the ink-firing chamber 207. The trench 211 has an open end 213 to the ink refill channel 215 and terminates at an outlet 221 in the floor of the ink-firing chamber 207 so as to provide an ink flow path between the ink refill channel 215 and the ink-firing chamber 207. The trench 211 provides an additional ink flow path between the ink refill channel 215 and the ink-firing chamber 207, and it further enables rapid refill of ink to the ink-firing chamber 207.

A supporter 219 is also provided in a SiC/SiN layer 311 above a portion of the trench 211 to prevent the barrier layer 209 from sagging into the trench 211 and consequently to reinforce the support to the orifice plate 201 provided by the barrier layer 209.

Figure 4A:
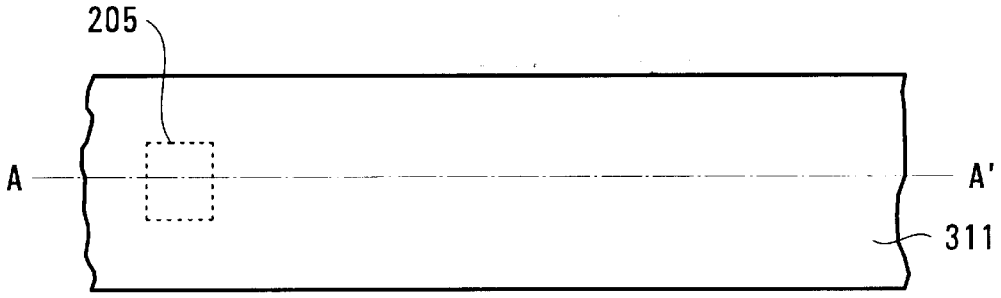
FIGS. 4A–4G are top plan views illustrating a process for fabricating an ink-firing element according to the invention.

With reference to FIGS. 4A–4G and 5A–5G, described is a sequence of illustrations of fabricating an ink-firing element having a trench and a supporter in an edge feed construction. FIGS. 4A–4G are top plan views, while FIGS. 5A–5G are cross section views along line A–A' which is shown in FIG. 4A.

Figure 5A:
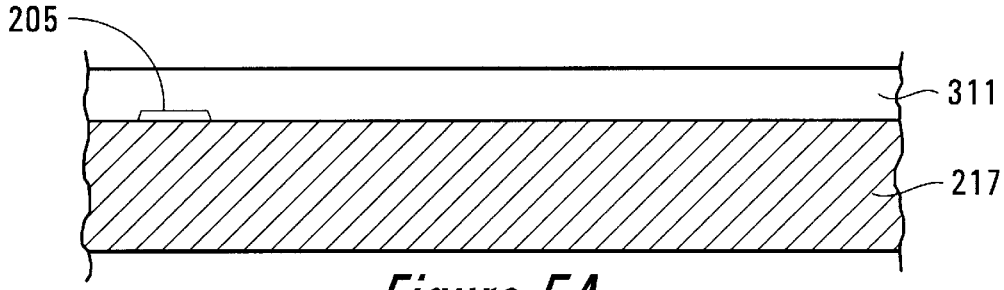
FIGS. 5A–5G are cross section views illustrating the process of FIGS. 4A–4G.

As shown in FIGS. 4A and 5A, a SiC/SiN layer 311 is first deposited onto an upper surface of the substrate 217, as well as atop the resistor 205. Normally, the SiC/SiN layer 311 is to prevent the resistor 205 and the substrate 217 from corrosion. In the preferred embodiment of the invention, such a layer is also to form the supporter 219 for supporting a portion of the barrier layer 209 thereabove.

Figure 4B:
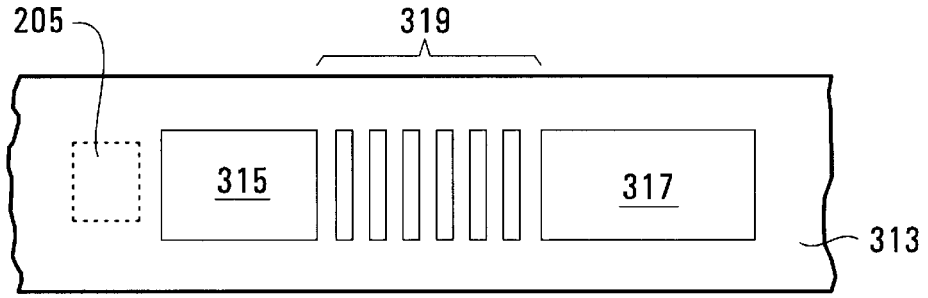
Figure 5B:
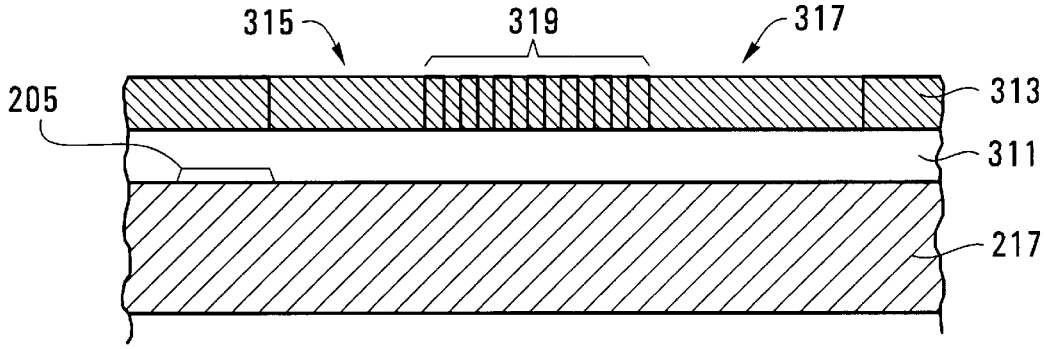

In FIGS. 4B and 5B, a patterned photoresist layer 313 is placed above the SiC/SiN layer 311. With reference to FIG. 1, the photoresist layer 313 has a first blank area 315 adjacent to the resistor 205 for etching a part of the SiC/SiN layer 311. The first blank area is positioned such that the part of the SiC/SiN layer etched and consequently the outlet of the trench formed thereafter would fall within the ink-firing chamber 207. Next to the first blank area 315, a plurality of blank strips which are substantially parallel to each other is provided in the photoresist layer 313 for forming a second part of the trench. The blank strips divides a part of the photoresist layer 313 into a plurality of photoresist strips 319 under which the supporter 219 in the SiC/SiN layer 313 is to be formed. Furthermore, the photoresist strips 319 are positioned at a place where a portion of the barrier layer 207 would be placed. Thereby, the supporter 219 thus formed can provide support to the barrier layer 207 thereabove and prevent the portion of the barrier layer from sagging into the trench. Next to the photoresist strips 319, a second blank area 317 is provided in the photoresist layer 313 for etching another part of the SiC/SiN layer. The open end 213 of the trench 211 will be formed in this area.

Figure 4C:
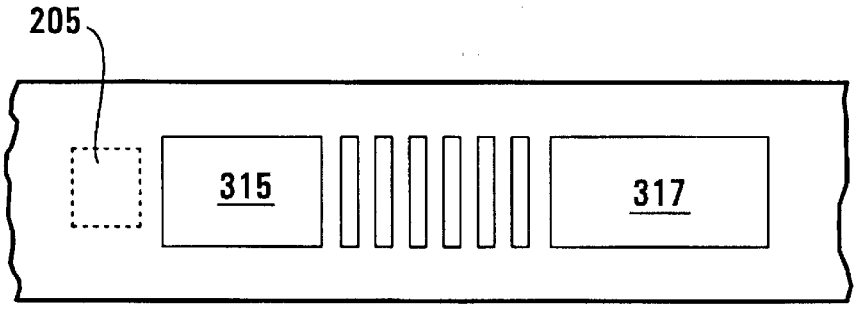
Figure 5C:
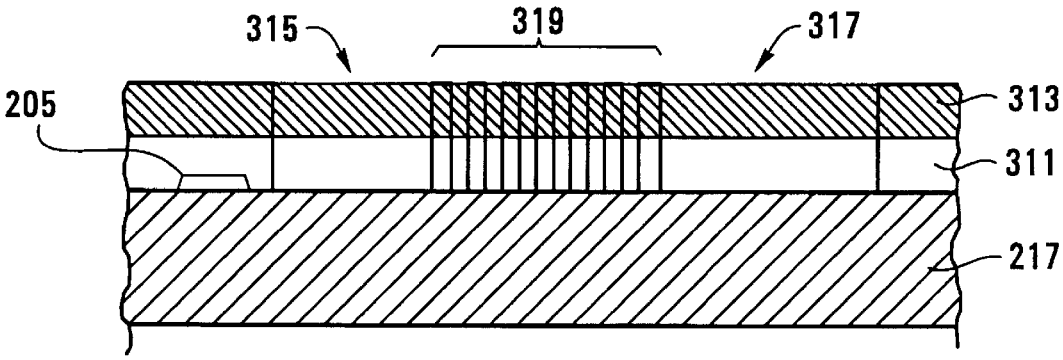
Figure 4D:
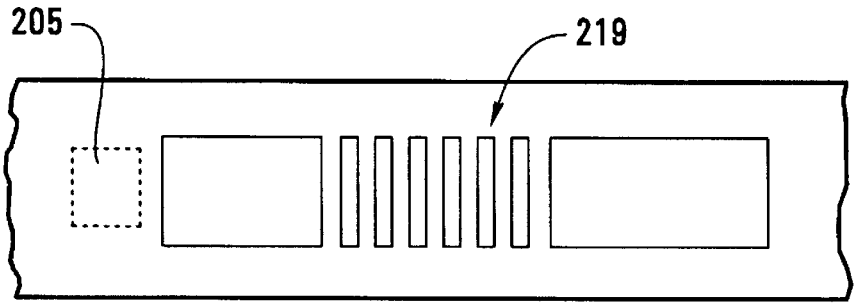
Figure 5D:
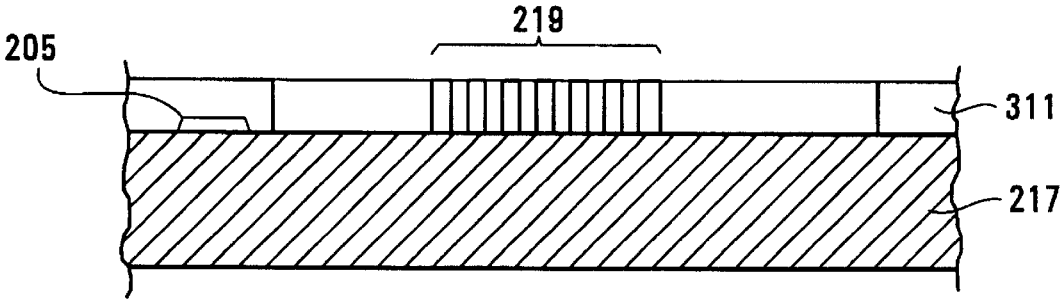

Subsequently, in FIGS. 4C and 5C, sulphur hexafluoride (SF6) is used to dry etch away unwanted areas of the SiC/SiN layer 311. After such a dry etch step, the SiC/SiN layer 311 has the same pattern as the photoresist layer 313. Next, the photoresist layer 313 is removed by using for example oxygen plasma. As shown in FIGS. 4D and 5D, the supporter 219 is now formed in the SiC/SiN layer 311. Note that the supporter 219 is formed by etching away part of the SiC/SiN layer 311. As part of the remaining SiC/SiN layer 311, the supporter 219 is connected to other parts of the SiC/SiN layer 311 as shown in FIG. 4D. Such a connection enables the supporter 219 to provide support to the barrier layer 209 thereabove when the barrier layer is paced atop the SiC/SiN layer 311.

Figure 4E:
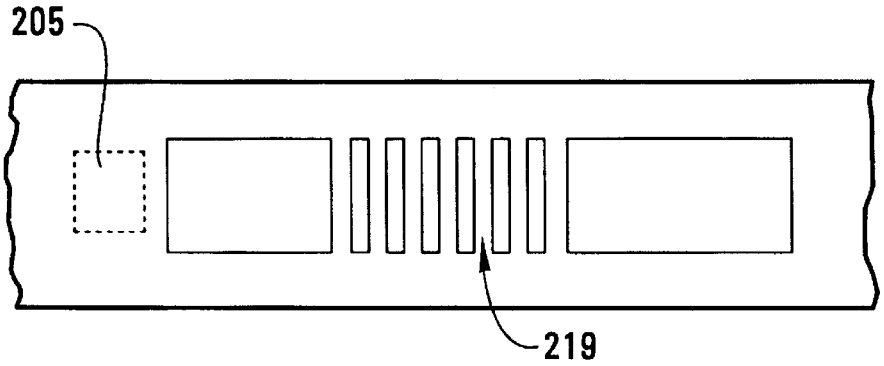
Figure 5E:
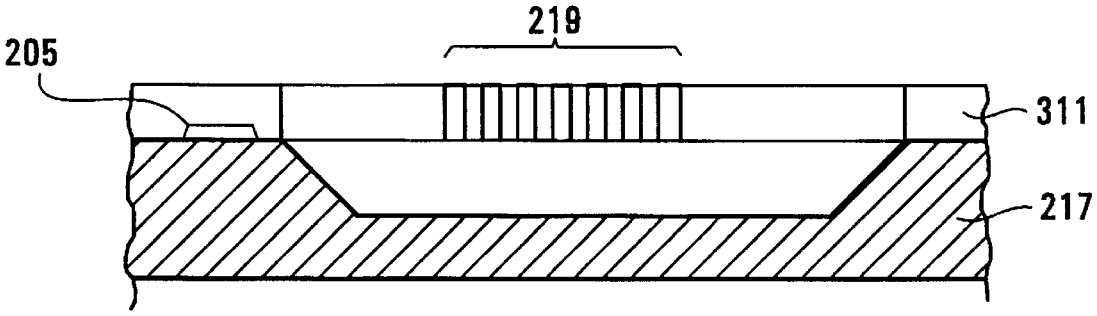

Then in FIGS. 4E and 5E, for a substrate made of silicon, tetra-methyl ammonia hydroxide (TMAH) is used to etch the trench 211 in the substrate 217 right below the SiC/SiN layer 311. The trench is preferably in a V-shape due to the nature of wet etch on Silicon crystal. This process is generally understood by those with ordinary skill in this field.

Figure 4F:
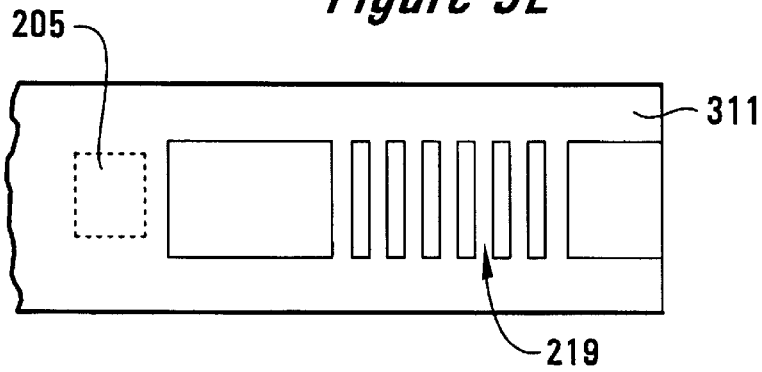
Figure 5F:
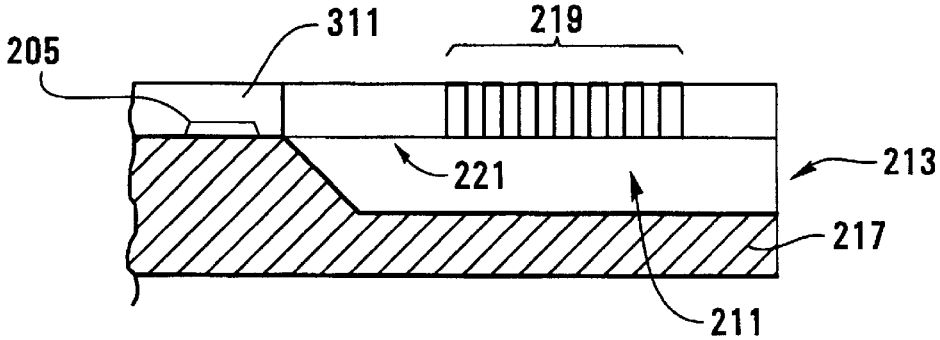

Further, in FIGS. 4F and 5F, the substrate 217 with the SiC/SiN layer above is sawed to remove part of the substrate 217 as well as part of the SiC/SiN layer 311. The trench 211; which terminates at an outlet 221 in the floor of the ink-firing chamber 207 and has an open end 213 to the ink refill channel 215, is thus formed in the substrate 217 with a supporter 219 in the SiC/SiN layer 311 thereabove.

Figure 4G:
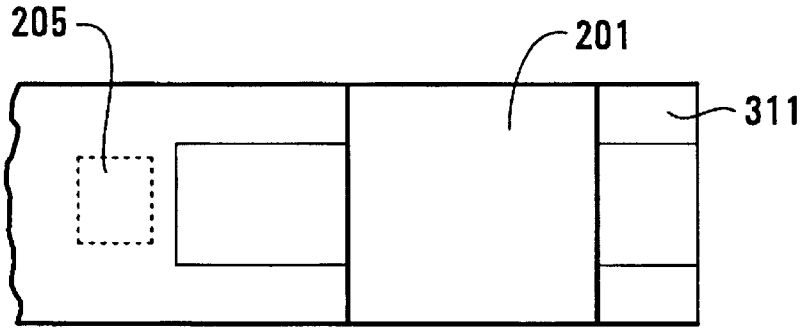
Figure 5G:
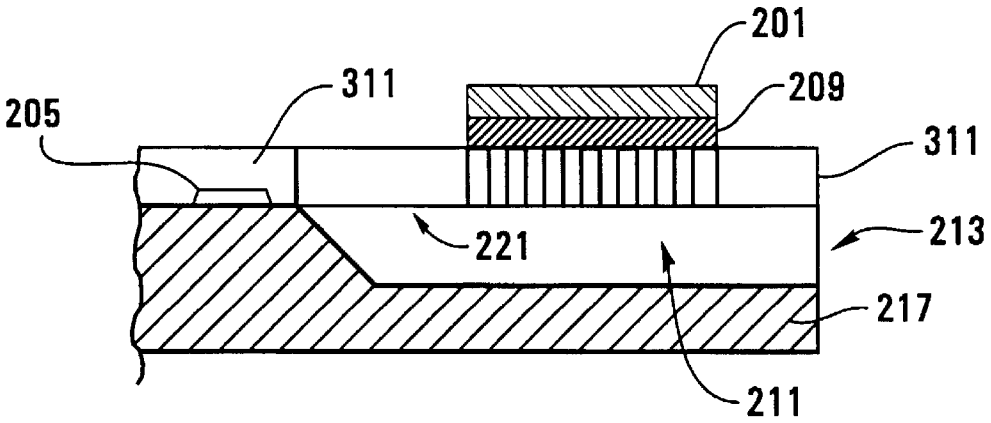

Having such a substrate with the trench, as shown in FIGS. 4G and 5G, the ink-firing element 200 can be formed by sequentially attaching a barrier layer 209 and an orifice plate 201. The barrier layer 209 can have an ink conduit 301 therein. Alternatively, the barrier layer 209 can be in a closed-loop design. The process of attaching the barrier layer 209 and the orifice plate 201 is generally understood by those with ordinary skill in this field.

Although it is only described herein a process of forming an ink-firing element in an edge feed construction, it is understood that the invention can be applied to form an ink-firing element in other constructions, for example, the center feed construction.

Alternatives can be made to the embodiments described above. For example, a metal layer, such as a tantalum (TA) layer, can be used to provide the supporter. In that case, after the tantalum layer is covered by the photoresist layer 313, wet etching technology is used to remove unwanted tantalum using, for example, acetic acid. Further, the supporter 219 may not be necessary. In that case, in the process described together with FIGS. 4A–4F and 5A–5F, the SiC/SiN layer would not be deposited onto the substrate 217.

What is claimed is:

1. An ink-firing element in a printer cartridge, comprising:

a resistor for generating ink droplets;

a substrate atop which the resistor rests;

a barrier layer atop the substrate, wherein the barrier layer is in a closed-loop design and at least partially defines an ink-firing chamber which surrounds the resistor and temporarily contains ink;

an orifice plate supported by the barrier layer for providing an orifice through which the ink droplets are ejected onto a medium; and a trench in the substrate for replenishment of ink, wherein the trench terminates at an outlet in the ink-firing chamber and is in fluid communication with an ink refill channel which supplies ink from a reservoir to the resistor.

2. The ink-firing element of claim 1, further comprising a supporter above the trench for supporting a portion of the barrier layer thereabove.

3. The ink-firing element of claim 1, further comprising a supporting layer above the substrate, wherein the supporting layer includes a supporter above the trench for supporting a portion of the barrier layer thereabove.

4. The ink-firing element of claim 3, wherein the supporting layer is a silicon carbide layer.

5. The ink-firing element of claim 3, wherein the supporting layer is a silicon nitride layer.

6. The ink-firing element of claim 1, wherein the closed-loop structured barrier layer provides sufficient support to the orifice plate thereabove for reducing sag of the orifice plate.

7. An ink-firing element in a printer, comprising:

a resistor for generating ink droplets;

a substrate atop which the resistor rests;

a barrier layer atop the substrate, wherein the barrier layer partially surrounds the resistor and defines an ink-firing chamber;

an orifice plate supported by the barrier layer for providing an orifice through which the ink droplets are ejected onto a medium;

an ink conduit provided in the barrier layer for supplying ink from an ink refill channel to the ink-firing chamber, wherein the ink refill channel supplies ink from a reservoir to the resistor, and a trench provided in the substrate for supplementary replenishment of ink, wherein the trench is in fluid communication with the ink refill channel and terminates at an outlet in the ink-firing chamber.

8. The ink-firing element of claim 7, further comprising a supporter for supporting a portion of the barrier layer above the trench.

9. The ink-firing element of claim 7, further comprising a supporting layer above the substrate, wherein the supporting layer includes a supporter above the trench for supporting a portion of the barrier layer thereabove.

10. The ink-firing element of claim 7, wherein the maximum distance between two sides of the ink conduit is substantially reduced for preventing sag of the orifice plate.

* * * * *